US010156244B2

(12) United States Patent
Fulayter et al.

(10) Patent No.: US 10,156,244 B2
(45) Date of Patent: Dec. 18, 2018

(54) FAN ASSEMBLY

(71) Applicant: Rolls-Royce Corporation, Indianapolis, IN (US)

(72) Inventors: Roy D. Fulayter, Avon, IN (US); Jonathan M. Rivers, Danville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 237 days.

(21) Appl. No.: 15/042,569

(22) Filed: Feb. 12, 2016

(65) Prior Publication Data

US 2016/0238034 A1 Aug. 18, 2016

Related U.S. Application Data

(60) Provisional application No. 62/117,230, filed on Feb. 17, 2015.

(51) Int. Cl.

| | |
|---|---|
| ***F04D 29/66*** | (2006.01) |
| ***F04D 29/32*** | (2006.01) |
| ***F01D 5/16*** | (2006.01) |
| ***F01D 5/30*** | (2006.01) |

(52) U.S. Cl.

CPC ..... *F04D 29/668* (2013.01); *F01D 5/16* (2013.01); *F01D 5/3015* (2013.01); *F04D 29/325* (2013.01); *F05D 2220/36* (2013.01); *F05D 2230/60* (2013.01); *F05D 2260/961* (2013.01)

(58) Field of Classification Search

CPC ..... F01D 5/16; F01D 5/3015; F04D 29/325; F04D 29/668; F05D 2220/36; F05D 2230/60; F05D 2260/961

USPC ..... 416/193, 500

See application file for complete search history.

(56) References Cited

U.S. PATENT DOCUMENTS

| | | | | |
|---|---|---|---|---|
| 3,644,058 | A * | 2/1972 | Barnabei | F01D 5/081 416/95 |
| 3,751,183 | A * | 8/1973 | Nichols | F01D 5/22 416/220 R |
| 4,019,833 | A * | 4/1977 | Gale | F01D 5/30 416/218 |
| 4,097,192 | A | 6/1978 | Kulina | |
| 4,182,598 | A * | 1/1980 | Nelson | F01D 5/22 416/193 A |
| 4,192,633 | A * | 3/1980 | Herzner | F01D 5/10 415/119 |
| 4,349,318 | A * | 9/1982 | Libertini | F01D 5/326 416/220 R |

(Continued)

FOREIGN PATENT DOCUMENTS

| | | |
|---|---|---|
| EP | 2290244 A2 | 3/2011 |
| FR | 2971822 A1 | 8/2012 |

OTHER PUBLICATIONS

Extended European Search Report, European Application No. 16155323.5-1610 / 3073052, dated Aug. 31, 2016, 7 pages.

*Primary Examiner* — William McCalister

(74) *Attorney, Agent, or Firm* — Barnes & Thornburg LLP

(57) ABSTRACT

A fan assembly for use in a gas turbine engine includes a fan wheel and a plurality of blades extending radially from the fan wheel away from a central axis of the fan assembly. Each of the blades includes a root coupled with the fan wheel and an airfoil extending radially outwardly from the root. The blades are adapted to rotate about the central axis to push air.

17 Claims, 3 Drawing Sheets

(56) References Cited

U.S. PATENT DOCUMENTS 4,405,285 A * 9/1983 Surdi ..... F01D 5/326 411/107
4,478,554 A * 10/1984 Surdi ..... F01D 5/323 416/220 R
4,494,909 A * 1/1985 Forestier ..... F01D 5/22 416/190
4,721,434 A * 1/1988 Marshall ..... F01D 5/16 415/119
4,723,889 A * 2/1988 Charreron ..... F01D 5/22 416/193 A
4,872,812 A * 10/1989 Hendley ..... F01D 5/22 416/190
5,205,713 A * 4/1993 Szpunar ..... F01D 5/26 416/193 A
5,277,548 A 1/1994 Klein et al.
5,478,207 A * 12/1995 Stec ..... F01D 5/22 416/219 R
5,498,136 A * 3/1996 Namura ..... F01D 5/225 416/190
5,501,575 A * 3/1996 Eldredge ..... F01D 5/3015 416/144
5,820,346 A * 10/1998 Young ..... F01D 5/22 416/193 A
5,913,660 A * 6/1999 Knott ..... F01D 5/30 416/219 R
5,993,161 A 11/1999 Shapiro
6,250,883 B1 6/2001 Robinson et al.
6,379,112 B1 4/2002 Montgomery
6,520,743 B2 * 2/2003 Arilla ..... F01D 5/3015 416/204 A
6,846,159 B2 1/2005 Zabawa et al.
6,951,448 B2 10/2005 Duesler et al.
7,153,098 B2 12/2006 Zabawa
RE39,630 E * 5/2007 Stangeland ..... F01D 5/10 416/190
7,252,481 B2 * 8/2007 Stone ..... F01D 5/02 416/239
7,500,299 B2 3/2009 Dupeux et al.
8,469,670 B2 * 6/2013 Fulayter ..... F01D 5/16 416/221
8,911,210 B2 * 12/2014 Bilz ..... F01D 5/10 416/193 A
2005/0254958 A1 11/2005 Stone
2007/0175032 A1 8/2007 Kurt-Elli
2010/0150725 A1 6/2010 Krautheim
2010/0329873 A1 12/2010 Ruba et al.
2011/0052398 A1 3/2011 Fulayter et al.
2011/0076148 A1 3/2011 Fulayter et al.
2012/0051918 A1 3/2012 Glasspoole et al.
2012/0128498 A1 5/2012 Basiletti et al.
2012/0201681 A1 8/2012 Chauveau et al.
2012/0244001 A1 9/2012 Belmonte et al.
2012/0263597 A1 10/2012 Delapierre et al.

* cited by examiner

FAN ASSEMBLY

CROSS REFERENCE TO RELATED APPLICATIONS

This application claims priority to and the benefit of U.S. Provisional Patent Application No. 62/117,230, filed 17 Feb. 2015, the disclosure of which is now expressly incorporated herein by reference.

FIELD OF THE DISCLOSURE

The present disclosure relates generally to gas turbine engines, and more specifically to fan assemblies used in gas turbine engines.

BACKGROUND

Gas turbine engines used to power aircraft often include a relatively-large diameter fan assembly that is driven by an engine core. The fan assembly blows air to provide thrust for moving the aircraft. Such fans typically include a fan wheel mounted to the engine core to be rotated by the engine core and a plurality of blades mounted to the fan wheel to rotate with the fan wheel to push air.

During operation, the blades may experience an undesirable dynamic instability called flutter. Flutter may occur when energy associated with the airflow through the fan assembly is transferred to the blades in the form of vibrations. Flutter in the fan assembly may cause high-cycle fatigue blade failure.

SUMMARY

The present disclosure may comprise one or more of the following features and combinations thereof.

According to an aspect of the present disclosure, a fan assembly may include a fan wheel, a plurality of blades, and an annular mistuning band. The plurality of blades may extend radially from the fan wheel away from a central axis. Each of the blades may include a root coupled with the fan wheel and an airfoil extending radially outwardly from the root. The annular mistuning band may be positioned adjacent to the fan wheel along the central axis and engaged with the roots of a predetermined number of more than one but less than all of the plurality of blades.

In some embodiments, the plurality of blades may be spaced circumferentially from one another about the fan wheel. The annular mistuning band may engage every other root of the plurality of blades. In some embodiments, the annular mistuning band may engage the roots of less than half of the plurality of blades.

In some embodiments, the fan assembly may have a fore end and an aft end. The fan assembly may further include a fore retainer located toward the fore end. The annular mistuning band may be located toward the aft end and may be spaced apart from the fore retainer to locate the plurality of blades therebetween.

In some embodiments, the fan assembly may have a fore end and an aft end. The fan assembly may further include an aft retainer located toward the aft end. The annular mistuning band may be located toward the fore end and may be spaced apart from the aft retainer to locate the plurality of blades therebetween.

In some embodiments, the fan wheel may be formed to include a plurality of axially extending slots. The root of each blade may be received in a corresponding slot. The root of each of the predetermined number of blades may extend axially out of the slots. The annular mistuning band may engage a portion of the roots extending axially out of the slots.

In some embodiments, the annular mistuning band may include an annular body and a plurality of engagement flanges extending radially outward away from the annular body and may be spaced circumferentially apart from one another. In some embodiments, the annular mistuning band may be castellated.

According to another aspect of the present disclosure, a fan assembly may include a fan, a fore retainer, an aft retainer, and an annular mistuning band. The fan may include a fan wheel and a plurality of blades extending radially outward from the fan wheel relative to a central axis. Each of the blades may include a root coupled with the fan wheel and an airfoil extending radially outward from the root. The fore retainer may be coupled to the fan wheel and adapted to limit axial movement of the plurality of blades along the central axis. The aft retainer may be spaced apart axially from the fore retainer to locate the plurality of blades therebetween. The aft retainer may be coupled to the fan wheel and adapted to limit axial movement of the plurality of blades. The annular mistuning band may extend around the central axis. The annular mistuning band may be positioned axially between the fore retainer and the aft retainer and may engage the root of a predetermined number of more than one but less than all of the plurality of blades.

In some embodiments, the annular mistuning band may include an annular body and a plurality of engagement flanges. The engagement flanges may extend radially outward from the annular body and may be spaced apart circumferentially from one another.

In some embodiments, the annular body may be spaced apart from the roots of the blades and the plurality of engagement flanges may engage the predetermined number of blades. In some embodiments, the annular mistuning band may be castellated.

In some embodiments, the fan wheel may be formed to include a plurality of axially extending slots. The root of each blade may be received in a corresponding slot. The root of each of the predetermined number of blades may extend axially beyond the slots. The engagement flanges may engage a portion of the roots extending axially beyond the slots.

In some embodiments, the annular mistuning band may further include a lip extending axially away from the annular body. The lip may be located radially between the central axis and the portion of the roots extending axially beyond the slots to center the annular mistuning band relative to the central axis. In some embodiments, the annular mistuning band may engage the roots of less than half of the plurality of blades.

According another aspect of the present disclosure, a method of assembling a fan assembly may include a number of steps. The method may include coupling roots of a plurality of blades to a fan wheel so that the blades extend radially from the fan wheel away from a central axis to provide a fan, and positioning an annular mistuning band that extends around the central axis adjacent to the fan along the central axis such that the annular mistuning band contacts the root of a predetermined subset of more than one but less than all of the plurality of blades.

In some embodiments, the method may further include clamping the annular mistuning band and the predetermined subset of blades between a fore retainer and an aft retainer of the fan assembly. In some embodiments, the method may further include clamping the predetermined subset of blades between a fore retainer of the fan assembly and the annular mistuning band.

In some embodiments, the plurality of blades may be spaced circumferentially from one another about the fan wheel. The annular mistuning band may engage every other root of the plurality of blades. In some embodiments, the annular mistuning band may engage the roots of less than half of the plurality of blades.

These and other features of the present disclosure will become more apparent from the following description of the illustrative embodiments.

DETAILED DESCRIPTION OF THE DRAWINGS

Figure 1:
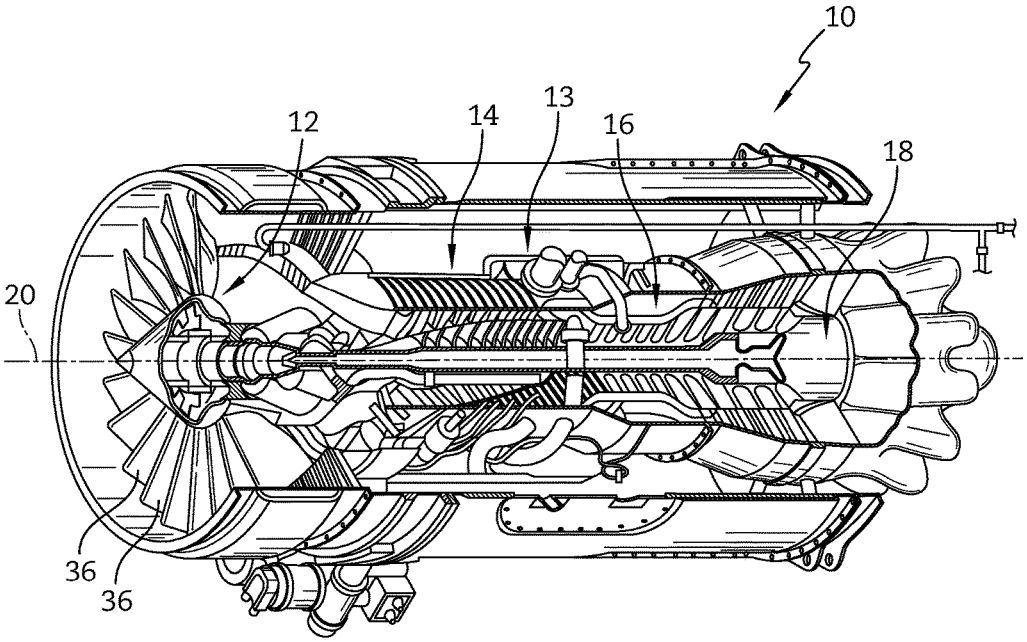
FIG. 1 is a cut-away perspective view of a gas turbine engine including a fan configured to push air and a mistuning band engaged with the fan to mistune the fan.

For the purposes of promoting an understanding of the principles of the disclosure, reference will now be made to a number of illustrative embodiments illustrated in the drawings and specific language will be used to describe the same.

An illustrative aerospace gas turbine engine 10 for use in an aircraft is cut-away to show that the engine 10 includes a fan assembly 12 and an engine core 13 adapted to drive the fan assembly 12 as shown in FIG. 1. The fan assembly 12 is adapted to push air to propel an aircraft. The engine core 13 includes a compressor 14, a combustor 16, and a turbine 18 as shown in FIG. 1. The compressor 14 compresses and delivers air to the combustor 16. The combustor 16 mixes fuel with the compressed air received from the compressor 14 and ignites the fuel. The hot, high-pressure products of the combustion reaction in the combustor 16 are directed into the turbine 18 and the turbine 18 extracts work to drive the compressor 14 and the fan assembly 12.

Figure 2:
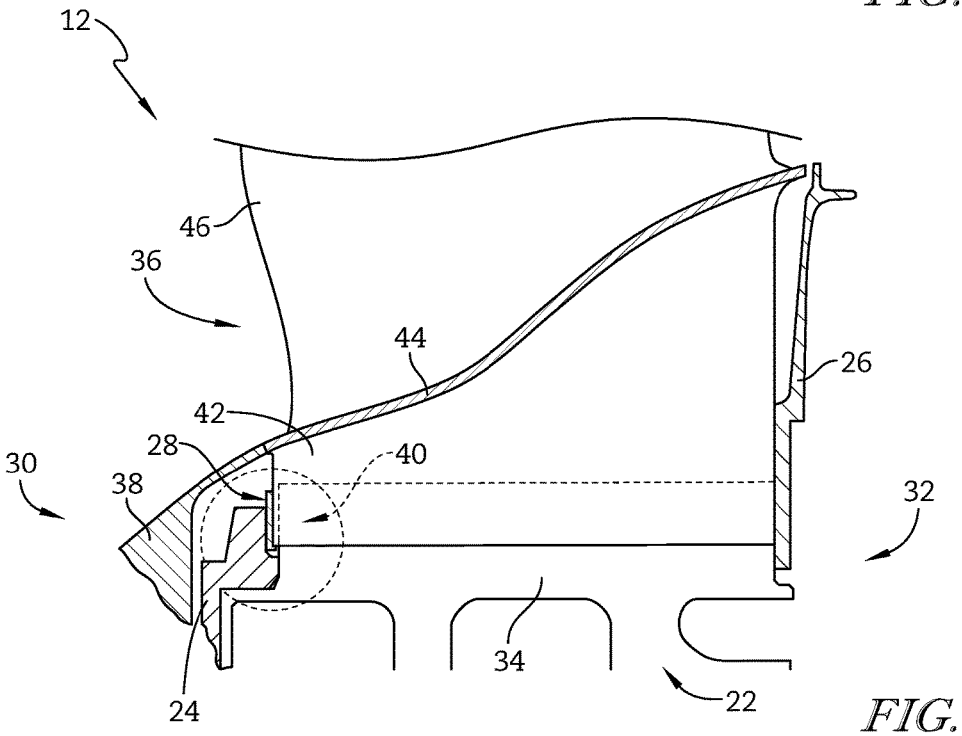
FIG. 2 is a cross-sectional view of the fan assembly included in the gas turbine engine of FIG. 1 showing that the fan includes a fan wheel and a plurality of blades extending radially from the fan wheel and that the mistuning band engages a subset of the blades to mistune the fan.

The illustratively fan assembly 12 includes a plurality of fan blades 36 for pushing air and a mistuning band 28 which engages a predetermined number of the fan blades 36 to mistune the fan assembly 12 as shown in FIG. 2. Mistuning of the fan assembly 12 may provide a flutter margin benefit and may improve the efficiency of the fan assembly 12.

The illustrative fan assembly 12 includes a fan 22, a fore retainer 24, an aft retainer 26, and the mistuning band 28 as shown in FIG. 2. The fan 22 is configured to rotate about a central axis 20 of the engine 10 to push air. The fore retainer 24 is located toward a fore end 30 of the fan assembly 12 to limit movement the fan 22 in the fore direction. The aft retainer 26 is located toward an aft end 32 of the fan assembly 12 to limit movement the fan 22 in the aft direction. The mistuning band 28 is configured to engage a portion of the fan 22 to mistune the fan 22. A spinner assembly 38 is coupled with the fan assembly 12 in the illustrative embodiment.

The fan 22 includes a fan wheel 34 and a plurality of blades 36 extending radially from the fan wheel 34 away from the central axis 20 as shown in FIG. 2. The fan wheel 34 is powered by the turbine 18 and configured to rotate about the central axis 20. The blades 36 are coupled with the fan wheel 34 for movement therewith. As such, the blades 36 are arranged to rotate with the fan wheel 34 to push air.

Figure 3:
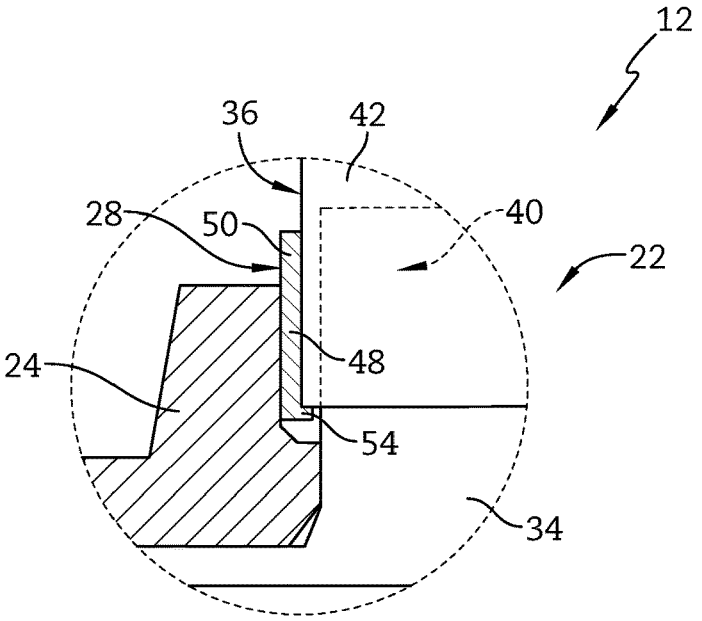
FIG. 3 is a detail view of the fan assembly of FIG. 2 showing that the mistuning band is clamped between a fore retainer of the fan assembly and the root of a blade to stiffen the blade.

The illustrative fan wheel 34 is formed to include a plurality of radially inwardly extending slots 40 shown in phantom in FIGS. 2 and 3. The slots 40 are spaced circumferentially apart from one another and extend axially through the fan wheel 34. Each slot 40 is adapted to receive one of the blades 36 and to block the blade 36 from escaping radially out of the slot 40.

Each blade illustratively includes a root 42, a platform 44, and an airfoil 46 as shown in FIG. 2. The root 42 of each blade 36 is adapted to be received in a corresponding slot 40. Each platform 44 extends away from the root 42 and is about flush with a spinner assembly 38 in the illustrative embodiment. Illustratively, the platforms 44 form an inner boundary of a flow path of air pushed by the fan assembly 12. Each airfoil 46 extends radially outwardly from a root 42. The airfoils 46 extend into the flow path in the illustrative embodiment.

The fore retainer 24 extends radially outward to limit forward axial movement of the blades 36 and block the blades 36 from escaping from the slots 40 at the fore end 30 as shown in FIG. 2. The fore retainer 24 is coupled to the fan 22 toward the fore end 30 for movement therewith. As such, the fore retainer 24 is adapted to rotate about the central axis 20 with the fan 22.

The aft retainer 26 extends radially outward to limit rearward axial movement of the blades 36 and block the blades 36 from escaping from the slots 40 at the aft end 32 as shown in FIG. 2. The aft retainer 26 is coupled to the fan 22 toward the aft end 32 for movement therewith. As such, the aft retainer 26 is adapted to rotate about the central axis 20 with the fan 22.

The mistuning band 28 is positioned adjacent to the fan 22 along the central axis 20. The mistuning band 28 contacts the root 42 of a predetermined number of the plurality of blades 36 to mistune the fan assembly 12 and reduce flutter. In the illustrative embodiment, the mistuning band contacts more than one but less than all of the plurality of blades 36. The life of the blades 36 may be increased by reducing the flutter as the high cycle fatigue of the blades 36 may be reduced. In the illustrative embodiment, the mistuning band 28 is an annular mistuning band 28 that extends around the central axis 20.

In the illustrative embodiment, the roots 42 have an axial length that is longer than the slots 40. As such, each root 42 extends axially out of and beyond the slot 40 as shown in FIGS. 2 and 3. The mistuning band 28 is adapted to engage the portion of the roots 42 of the predetermined number of blades 36 that extends out of and beyond the slots 40. In other embodiments, the predetermined number of blades 36 may be axially longer than the remaining blades 36.

The plurality of blades 36 and the mistuning band 28 are positioned axially between the fore retainer 24 and the aft retainer 26 as shown in FIG. 2. The mistuning band 28 and the predetermined number of blades 36 are clamped between the fore retainer 24 and aft retainer 26 to cause the mistuning band 28 to engage the predetermined number of blades 36 and stiffen the predetermined number of blades 36 to mistune the fan assembly 12. In the illustrative embodiment, the mistuning band 28 is axially located between the fore retainer 24 and the blades 36. In other embodiments, the mistuning band 28 is axially located between the blades 36 and the aft retainer 26.

Figure 4:
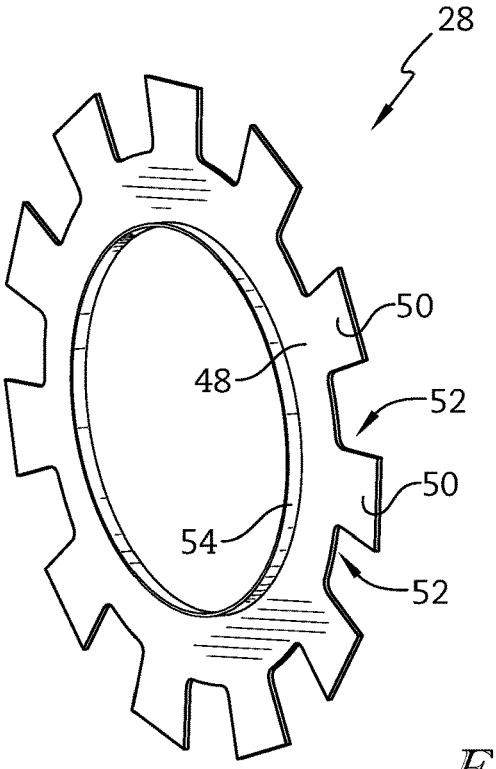
FIG. 4 is a perspective view of the mistuning band included in the fan assembly of FIG. 2.

In the illustrative embodiment, the mistuning band 28 includes an annular body 48, a plurality of engagement flanges 50 that extend radially outward away from the annular body 48, and an lip 54 that extends axially away from the annular body 48 as shown in FIG. 4. The annular body 48 forms a ring with an outer circumference and an inner circumference. The engagement flanges 50 are spaced circumferentially apart from one another to form apertures 52 therebetween. As shown in FIG. 4, the illustrative mistuning band 28 is castellated.

The engagement flanges 50 engage the predetermined number of blades 36 as shown in FIG. 3. The remaining blades 36 are not engaged by the mistuning band 28 due to the apertures 52. In the illustrative embodiment, the remaining blades 36 extend out of the fore end 30 of the slots 40 and into the apertures 52.

The lip 54 extends axially from the annular body 48 as shown in FIG. 4. The lip 54 is fully annular and extends along the inner circumference of the annular body 48. Illustratively, the lip 54 is located radially between the central axis 20 and the roots 42 of the blades 36 that extend beyond the slots 40. Radial movement of the lip 54 is blocked by the roots 42 to center the mistuning band 28 relative to the central axis 20. The lip 54 may engage the roots 42 to block radial movement of the mistuning band 28.

In some embodiments, the mistuning band 28 engages every other root 42 of the plurality of blades 36. In the illustrative embodiment, the mistuning band 28 engages the roots 42 of less than half of the plurality of blades 36. In other embodiments, the mistuning band 28 engages the roots 42 of more than half of the plurality of blades 36. In other embodiments, the mistuning band 28 is adapted to engage every third, fourth, or nth blade 36. In yet other embodiments, the mistuning band 28 may engage two or more adjacent blades 36.

In some embodiments, the mistuning band 28 is integrally formed with one or both of the fore retainer 24 and the aft retainer 26. In some embodiments, the mistuning band 28 is monolithically formed with one or both of the fore retainer 24 and the aft retainer 26. In some embodiments, the mistuning band 28 comprises a fret-resistant material. In some embodiments, an anti-fret coating is applied to one or more surfaces of the mistuning band. In the illustrative embodiment, the mistuning band 28 is consumable and disposable. In the illustrative embodiment, the mistuning band 28 comprises steel.

The mistuning band 28 may have a relatively large or relatively small thickness to vary the mistuning of the fan assembly 12. In some embodiments, the mistuning band 28 may have a thickness of between about three thousandths of an inch and about fifteen-thousandths of an inch.

According to at least one method of assembling the fan assembly 112, a sheet of material is stamped in a manufacturing process to form the mistuning band 28. The root 42 of each blade 36 is aligned with a corresponding slot 40 and translated into the slot 40 until a blade 36 is received in each slot 40. The aft retainer 26 is aligned with the fan wheel 34 relative to the central axis 20 and coupled with the fan wheel 34 at the aft end 32 of the fan assembly 12. The aft retainer 26 engages the blades 36 to cause a portion of the blades 36 to extend beyond the slots 40 at the fore end 30 of the fan assembly 12.

The mistuning band 28 is aligned with the fan wheel 34 relative to the central axis 20 and translated axially. The lip 54 of the mistuning band 28 is located radially between the central axis 20 and the portion of the roots 42 that extend beyond the slots 40. The engagement flanges 50 are engaged with the predetermined number of blades 36. The fore retainer 24 is aligned with the fan wheel 34 relative to the central axis 20 and coupled with the fan wheel 34 at the fore end 30 of the fan assembly 12. The fore retainer 24 and aft retainer 26 are tightened to apply a desired clamp force to the predetermined number of blades 36 and the mistuning band 28 to mistune the fan assembly 12.

Figure 5:
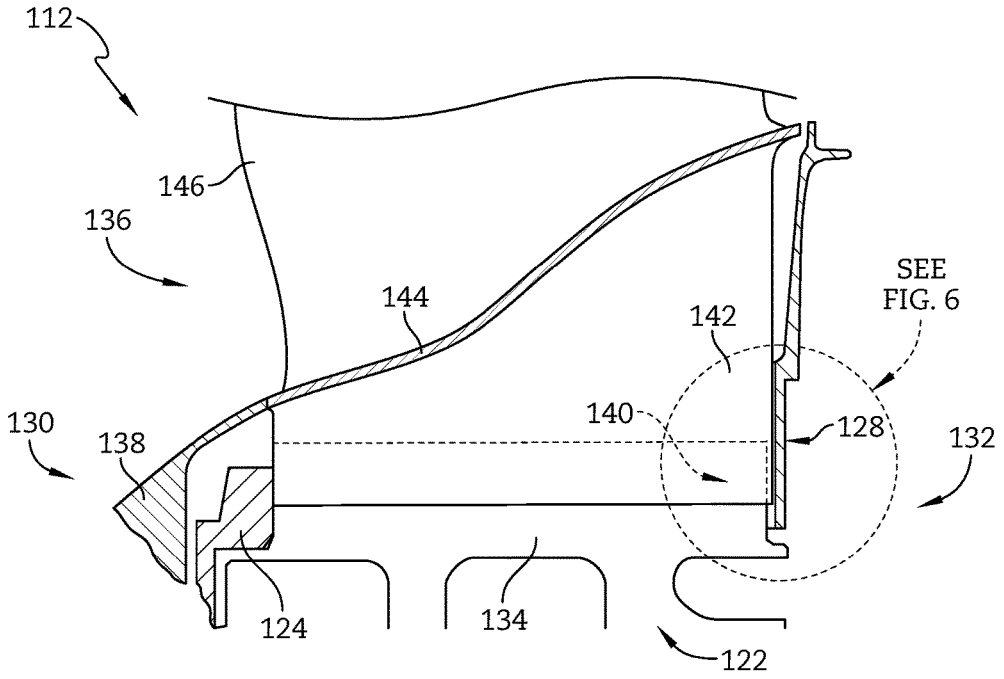
FIG. 5 is a cross-sectional view of another fan assembly for use with the gas turbine engine of FIG. 1 showing that that the fan assembly includes a mistuning band positioned at an aft end of a fan assembly and the mistuning band is configured to engage some of the blades to mistune the fan.
Figure 6:
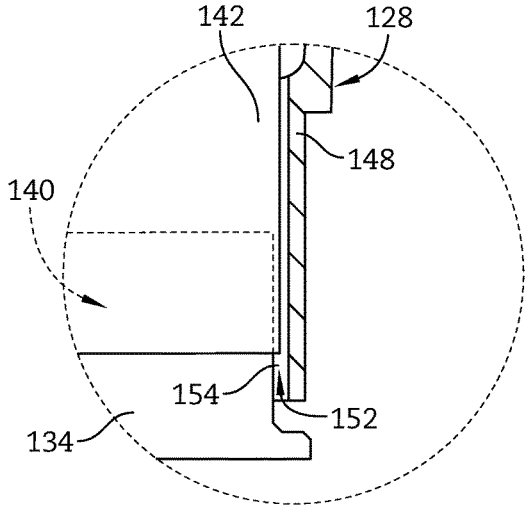
FIG. 6 is a detail view of the fan assembly of FIG. 5 showing that the mistuning band includes a plurality of apertures circumferentially spaced apart from one another to cause the mistuning band to be spaced apart from some of the blades and engaged with a predetermined number of blades to mistune the fan.

Another illustrative fan assembly 112 is shown in FIGS. 5 and 6. The fan assembly 112 is configured for use in the engine 10 and is substantially similar to the fan assembly 112 shown in FIGS. 1-4 and described herein. Accordingly, similar reference numbers in the 100 series indicate features that are common between the fan assembly 12 and the fan assembly 112. The description of the fan assembly 12 is hereby incorporated by reference to apply to the fan assembly 112, except in instances when it conflicts with the specific description and drawings of the fan assembly 112.

The fan assembly 112 includes a fan 122, a fore retainer 124, and a mistuning band 128 as shown in FIG. 5. The fan 122 is configured to rotate about a central axis 20 of the engine 10 to push air and propel the aircraft. The fore retainer 124 is located toward a fore end 130 of the fan assembly 112 to limit movement of portions of the fan 122. The mistuning band 128 is located toward an aft end 132 of the fan assembly 112 to limit movement of portions of the fan 122 and to engage a portion of the fan 122 to mistune the fan 122. A spinner assembly 138 is coupled with the fan assembly 112 in the illustrative embodiment.

The fore retainer 124 extends radially outward to limit forward axial movement of the blades 136 and block the blades 136 from escaping from the slots 140 at the fore end 130 as shown in FIG. 5. The fore retainer 124 is coupled to the fan 122 toward the fore end 130 for movement therewith. As such, the fore retainer 124 is adapted to rotate about the central axis 20 with the fan 122.

The mistuning band 128 extends radially outward to limit rearward axial movement of the blades 136 and block the blades 136 from escaping from the slots 140 at the aft end 132 as shown in FIG. 5. The mistuning band 128 is coupled to the fan 122 toward the aft end 132 for movement therewith. As such, the mistuning band 128 is adapted to rotate about the central axis 20 with the fan 122.

The mistuning band 128 contacts the root 142 of a predetermined number of the plurality of blades 136 to mistune the fan assembly 112. In the illustrative embodiment, the mistuning band 128 contacts the root 142 of more than one but less than all of the plurality of blades 136. In the illustrative embodiment, the mistuning band 128 is an annular mistuning band 28 that extends around the central axis 20.

In the illustrative embodiment, the roots 142 of the blades 36 have an axial length that is longer than the slots 140. As such, each root 142 extends axially in the aft direction out of and beyond the slot 140 as shown in FIGS. 5 and 6. The mistuning band 128 is adapted to engage the portion of the roots 142 of the predetermined number of blades 136 that extends out of and beyond the slots 140. In other embodiments, the predetermined number of blades 136 may be axially longer than the remaining blades 136.

The predetermined number of blades 136 are clamped between the fore retainer 124 and the mistuning band 128 to cause the mistuning band 128 to engage the roots 142 of the predetermined number of blades 136 and stiffen the predetermined number of blades 136 to mistune the fan assembly 112. In the illustrative embodiment, the mistuning band 128 is located toward the aft end 32. In other embodiments, the fan assembly 112 may include a mistuning band 128 located toward the fore end 130 and an aft retainer 126 located toward the aft end 132 to clamp the blades 136 between the mistuning band 128 and the aft retainer 126.

In the illustrative embodiment, the mistuning band 128 includes an annular body 148 formed to include a plurality of apertures 152 spaced circumferentially apart from one another and a lip 154 as shown in FIG. 6. The annular body 148 engages the predetermined number of blades 136. The remaining blades 136 are not engaged by the mistuning band 128 due to the apertures 152 as shown in FIG. 6. The lip 154 is located radially between the roots 142 and the central axis 20 to center the mistuning band 128 relative to the central axis 20.

In the illustrative embodiment, the remaining blades 136 extend out of the aft end 32 of the slots 140 and into the apertures 152 so that they are spaced apart from the mistuning band 128. In the illustrative embodiment, the mistuning band 128 is castellated. The annular body 148 illustratively extends radially outward toward the platform 144 to seal the fan assembly 112.

In some embodiments, the mistuning band 128 engages every other root 142 of the plurality of blades 136. In the illustrative embodiment, the mistuning band 128 engages the roots 142 of less than half of the plurality of blades 136. In other embodiments, the mistuning band 128 engages the roots 142 of more than half of the plurality of blades 136. In other embodiments, the mistuning band 128 is adapted to engage every third, fourth, or nth blade 136. In yet other embodiments, the mistuning band 128 may engage two or more adjacent blades 36.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A fan assembly for use in a gas turbine engine, the fan assembly comprising a fan wheel, a plurality of blades extending radially from the fan wheel away from a central axis, each of the blades including a root coupled with the fan wheel and an airfoil extending radially outwardly from the root, and an annular mistuning band positioned adjacent to the fan wheel along the central axis and engaged with the roots of a predetermined number of more than one but less than all of the plurality of blades, the annular mistuning band includes an annular body and a plurality of planar engagement flanges that extend radially outward away from the annular body, each of the plurality of planar engagement flanges being spaced apart circumferentially from a neighboring one of the plurality of planar engagement flanges, and the annular body and the plurality of planar engagement flanges cooperate to define a planar fore surface and a planar aft surface of the annular mistuning band, wherein the fan assembly has a fore end and an aft end, the fan assembly further includes an aft retainer located toward the aft end and engaged with the plurality of blades, and the annular mistuning band is located toward the fore end and is spaced apart from the aft retainer to locate the plurality of blades between the mistuning band and the aft retainer.

2. The fan assembly of claim 1, wherein the plurality of blades are spaced circumferentially from one another about the fan wheel and the annular mistuning band engages every other root of the plurality of blades.

3. The fan assembly of claim 1, wherein the annular mistuning band engages the roots of less than half of the plurality of blades.

4. The fan assembly of claim 1, wherein the fan wheel is formed to include a plurality of axially extending slots, the root of each blade is received in a corresponding slot, the root of each of the predetermined number of blades extends axially out of the slots, and the annular mistuning band engages a portion of the roots extending axially out of the slots.

5. The fan assembly of claim 1, wherein the annular mistuning band is castellated.

6. The fan assembly of claim 1, wherein the annular mistuning band further includes a lip that extends axially away from the annular body and the lip is located radially between the fan wheel and a portion of the roots included in the plurality of blades.

7. A fan assembly for use in a gas turbine engine, the fan assembly comprising a fan including a fan wheel and a plurality of blades extending radially outward from the fan wheel relative to a central axis, each of the blades including a root coupled with the fan wheel and an airfoil extending radially outward from the root, a fore retainer coupled to the fan wheel and adapted to limit axial movement of the plurality of blades along the central axis, an aft retainer spaced apart axially from the fore retainer to locate the plurality of blades therebetween, the aft retainer coupled to the fan wheel and adapted to limit axial movement of the plurality of blades, and an annular mistuning band extending around the central axis, the annular mistuning band positioned axially between the fore retainer and the aft retainer and engaging the root of a predetermined number of more than one but less than all of the plurality of blades, the annular mistuning band includes an annular body and a plurality of engagement flanges that extend radially outward away from the annular body and engage the root of the predetermined number of more than one but less than all of the plurality of blades, each of the plurality of engagement flanges being spaced apart circumferentially from a neighboring one of the plurality of engagement flanges, and the annular body and the plurality of engagement flanges cooperate to define a planar fore surface and a planar aft surface of the annular mistuning band, wherein the fan wheel is formed to include a plurality of axially extending slots, the root of each of the plurality of blades is received in a corresponding slot, the root of each of the predetermined number of blades extends axially beyond the corresponding slot, and the plurality of engagement flanges engage a portion of the roots that extends axially beyond the slots.

8. The fan assembly of claim 7, wherein the annular body is spaced apart from the roots of the blades.

9. The fan assembly of claim 7, wherein the annular mistuning band is castellated.

10. The fan assembly of claim 7, wherein the annular mistuning band engages the roots of less than half of the plurality of blades.

11. The fan assembly of claim 7, wherein the annular mistuning band further includes a lip that extends axially away from the annular body and the lip is located radially between the fan wheel and the portion of the roots that extend axially beyond the slots to locate the annular mistuning band relative to the central axis.

12. The fan assembly of claim 11, wherein the annular mistuning band is located axially between the fore retainer and the plurality of blades.

13. The fan assembly of claim 11, wherein the annular mistuning band is located axially between the aft retainer and the plurality of blades.

14. A method of assembling a fan assembly, the method comprising coupling roots of a plurality of blades to a fan wheel so that the blades extend radially from the fan wheel away from a central axis to provide a fan, and positioning an annular mistuning band that extends around the central axis adjacent to the fan along the central axis such that the annular mistuning band contacts the root of a predetermined subset of more than one but less than all of the plurality of blades, wherein the annular mistuning band includes an annular body, a plurality of planar engagement flanges, and an annular lip, the plurality of plan engagement flanges extend radially outward away from the annular body, each of the plurality of planar engagement flanges is spaced apart circumferentially from a neighboring one of the plurality of planar engagement flanges, the annular body and the plurality of planar engagement flanges cooperate to define a planar fore surface and a planar aft surface of the annular mistuning band, and the annular lip extends axially away from the annular body and is located radially between the fan wheel and the roots of the plurality of blades.

15. The method of claim 14, further including clamping the predetermined subset of blades between a fore retainer of the fan assembly and the annular mistuning band.

16. The method of claim 14, wherein the plurality of blades are spaced circumferentially from one another about the fan wheel and the annular mistuning band engages every other root of the plurality of blades.

17. The method of claim 14, wherein the annular mistuning band engages the roots of less than half of the plurality of blades.

* * * * *